US005303746A

United States Patent [19]

Wahhoud et al.

[11] Patent Number: 5,303,746

[45] Date of Patent: Apr. 19, 1994

[54] METHOD FOR CONTROLLING WEFT THREAD TRANSFER FROM EMPTY TO FULL BOBBIN DURING WEFT INSERTION

[75] Inventors: Adnan Wahhoud, Lindau; Dieter Teufel, Langenargen, both of Fed. Rep. of Germany

[73] Assignee: Lindauer Dornier Gesellschaft mbH, Lindau, Fed. Rep. of Germany

[21] Appl. No.: 946,884

[22] Filed: Sep. 17, 1992

[30] Foreign Application Priority Data

Sep. 21, 1991 [DE] Fed. Rep. of Germany ..... 4131474

[51] Int. Cl.[5] ..... D03D 47/30

[52] U.S. Cl. ..... 139/435.2

[58] Field of Search ..... 139/435.2, 435.1, 435.5

[56] References Cited

U.S. PATENT DOCUMENTS

| | | | |
|---|---|---|---|
| 4,532,964 | 8/1985 | Lerch | 139/435.2 |
| 4,550,753 | 11/1985 | Tsuji | 139/435.2 |
| 4,722,370 | 2/1988 | Manders | 139/435.2 X |
| 4,932,442 | 6/1990 | Ishido et al. | 139/435.2 |
| 5,031,672 | 7/1991 | Wahhoud et al. | 139/435.2 |

*Primary Examiner*—Andrew M. Falik
*Attorney, Agent, or Firm*—W. G. Fasse

[57] ABSTRACT

A running out weft thread end is transferred from a now empty bobbin to a full bobbin during the insertion of a weft thread into the shed of an air nozzle weaving loom from several thread supply bobbins is controlled to obtain a uniform weave even when the thread supply changes from an empty bobbin to a full bobbin. The transfer of the thread is detected and the respective signal is used to temporarily interpose on in a normal thread travelling pattern, a transitional travelling pattern to eliminate disadvantageous influences that affect the weft thread insertion during the transfer of the weft thread from one thread supply to the next. The transitional travelling pattern begins during or immediately after the detection of a thread transfer taking place. The transitional travelling pattern is maintained for a time sufficient to pull a starting amount of weft thread off from the thread supply or until the thread transit time has reached a rated value. Thereafter, the normal travelling pattern controlled by the weft thread insertion program is resumed.

11 Claims, 4 Drawing Sheets

METHOD FOR CONTROLLING WEFT THREAD TRANSFER FROM EMPTY TO FULL BOBBIN DURING WEFT INSERTION

FIELD OF THE INVENTION

The present invention relates to a method for controlling the inserting of a weft thread on an air nozzle weaving loom. The control is accomplished in response to the detection of a transition of the thread supply from an empty supply bobbin to a full supply bobbin.

BACKGROUND INFORMATION

For the operation of air nozzle looms it is generally known that the transport of the weft thread through the insertion channel in the reed and, here especially, the insertion time or speed needed for the weft thread insertion are dependent on several factors. Thus, for example, there are differences in the air effectiveness of the threads coming even from one and the same thread supply. There are variations in the winding density of the thread supply. These variations also have their influence on the weft thread insertion. More specifically, the weft threads of the upper thread layers on a bobbin have a less advantageous surface structure for the air effectiveness than the middle and inner layers of the thread supply. These adverse influences should be removed or compensated by a corresponding operational sequence during the weft thread insertion in the loom.

In order to be able to compensate for these shortcomings and to guarantee the insertion time or speed of the weft thread that is preset in the program control for a weaving cycle, methods are known which influence the insertion time or the speed of the weft thread by increasing or lowering the air impulse duration through the main nozzle of an air nozzle loom. A method for accomplishing such a control by the participation of the relay nozzles in the control or by using the relay nozzles themselves for the control is not known.

German Patent Publication DE-OS 3,818,766, corresponds to U.S. Pat. No. 5,031,672 (Wahhoud et al.), issued on Jul. 16, 1991. The disclosure of Wahhoud et al. is incorporated herein by reference. Wahhoud et al. control the relay nozzles in an air nozzle loom in such a way that different yarn qualities can be used for the weaving in consecutive working procedures. For this purpose, the relay nozzles are controlled in groups and the duration of the impulse length of the controlling is regulated depending on the air effectiveness of each yarn to be worked. Influences that are effective during the transfer of the weft thread from one thread supply bobbin onto another supply bobbin, and which affect the weaving process negatively, cannot be eliminated by this known method.

These shortcomings also arise in the same manner when weaving threads having the same quality, which are however, pulled off from two different but connected thread supply bobbins. Further adverse influences arise, namely those that occur if the first thread supply bobbin from which the weft thread is now being pulled comes to an end and a transfer is made to the next thread supply bobbin, whereby the thread end of the supply bobbin that is running out is connected to the beginning of the thread of the full supply bobbin.

Although, as explained above, the weft thread quality is assumed to be the same for all bobbins, the influences that result from the thread transfer cannot be removed easily through the known relay nozzle control. For such a control it would be necessary to establish for the individual relay nozzles or groups of relay nozzles, a new travelling field or travel pattern in accordance with a respective program and to maintain the new travelling field by supplying a comparatively higher pressure, namely to satisfy a higher energy requirement that must be applied to transport the weft thread. Thus, the once preset insertion parameters for the weft thread would have to be changed, which would not be without influence on the productivity or efficiency of the loom. Further, this measure would cause an undesired high consumption of insertion fluid, which is unacceptable.

OBJECTS OF THE INVENTION

In view of the above it is the aim of the invention to achieve the following objects singly or in combination:

- to form a thread transfer travelling field or weft travel pattern in addition to the normal travelling field or pattern that is formed by the relay nozzles in the weft thread insertion channel in accordance with the control program, and to interpose the transfer travel pattern on the normal travel pattern, for the transport of the weft thread through the insertion channel,
- to eliminate the disadvantageous influences which affect the weft thread insertion during the transfer of the weft thread from one thread supply to the next; and
- to assure a uniform weave independently of any adverse influences on the air effectiveness of any particular weft thread quality.

SUMMARY OF THE INVENTION

The foregoing objects have been achieved in an air loom by operating or controlling the air nozzles for the transport of the weft thread through the weft insertion air channel according to the invention as follows: First, a sensor signal determines a time period when a weft thread transfer from one supply bobbin to another supply bobbin is taking place. During or directly following a transfer of the weft thread from one thread supply bobbin to the next bobbin, a thread transfer travelling pattern is temporarily interposed on the travelling pattern formed according to a normal relay nozzle operation control program, the thread transfer travelling pattern is maintained until a starting quantity of weft thread from the next thread supply bobbin is pulled off or until the thread transit time has reached its rated value; and then returning to the travelling pattern formed according to the normal nozzle operation control program.

It has been found that preventing the disadvantageous influences on the weft thread insertion during transfer of the weft thread from an empty to a full thread supply bobbin, can essentially only be achieved by a temporary increase of the impulse duration of the groups of relay nozzles that form the weft thread travelling pattern according to the normal nozzle operation control program. Surprisingly, it has also been found that the increase of the impulse duration by means of the thread transfer travelling pattern is needed only for a few inserted weft threads in the transit time, whereby it is guaranteed that an estimated substantial increase in the air consumption for forming and maintaining the weft thread transfer travelling pattern did not materialize in practice. Rather, the increase in air consumption by the relay nozzles is quite modest.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
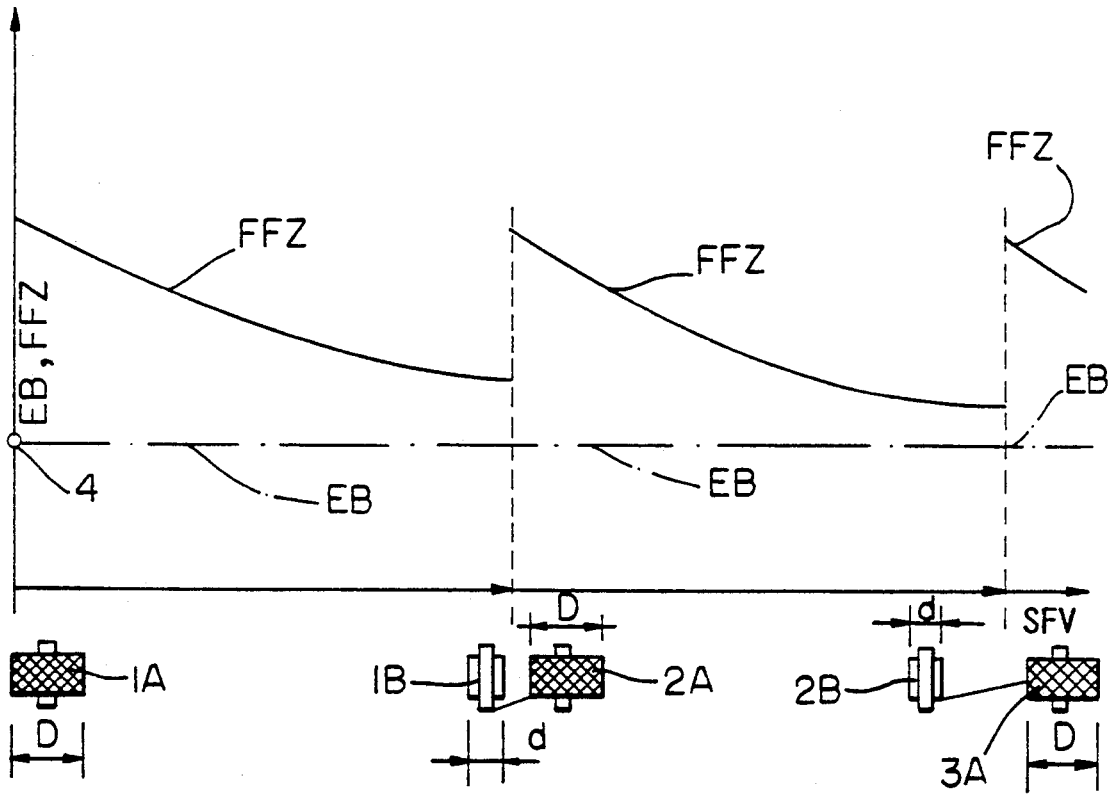
FIG. 1 PRIOR ART
FIG. 1 shows the dependence of the weft thread transit time (FFZ) and the energy requirement (EB) on the diameter of the thread spool, without any regulation of the weft thread insertion.
Figure 2:
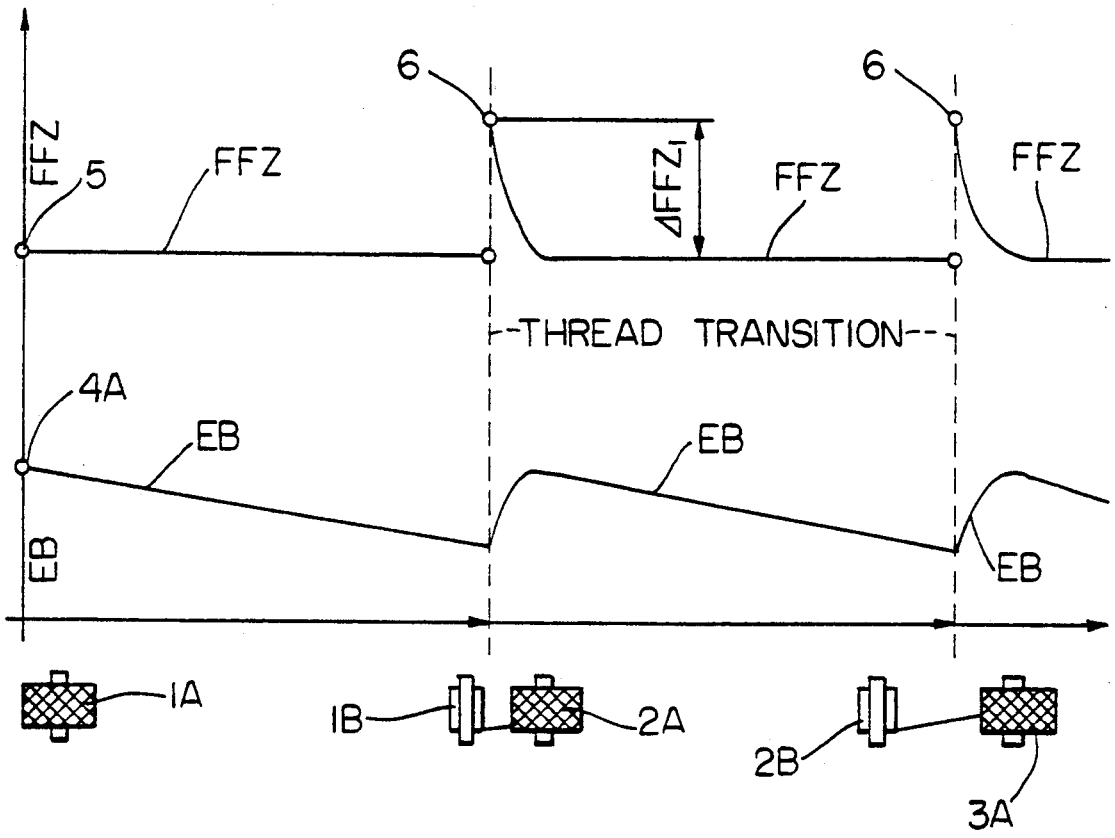
FIG. 2 shows the dependence of the weft thread transit time (FFZ) and the energy requirement (EB) on the diameter of the thread spool, with a conventional regulation of the weft thread insertion nozzles, however, without the use of a weft thread transfer sensor.
Figure 3:
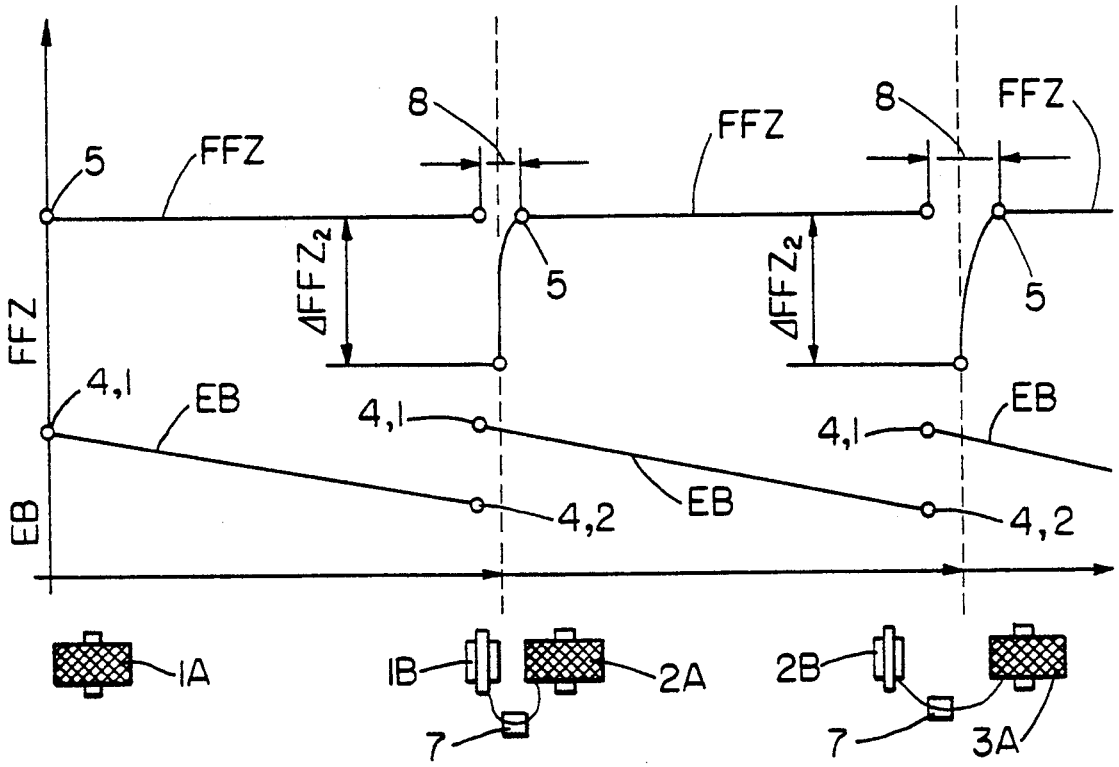
FIG. 3 shows the dependence of the weft thread transit time (FFZ) and the energy requirement (EB) on the diameter of the thread spool, while using a weft thread transfer sensor which provides a signal indicating that the weft thread supply has passed from an empty bobbin to a full bobbin and using said signal for controlling the weft thread insertion.

In FIGS. 1 to 3, the influence of the reduction of the bobbin diameter on an air nozzle loom is depicted in diagrams. More specifically, the influence of the weft thread use that leads to a reduction of the bobbin diameter on the important insertion parameters, such as the thread transit time FFZ and the energy EB required for transporting a weft thread through the air insertion channel, are depicted. The thread transit time FFZ is the time needed by the weft thread for passing through the air insertion channel beginning when the weft thread enters the insertion side of the channel and ending when the weft thread exits from the channel on the exit side of the loom. The energy EB is measured as the amount of fluid used per unit of time for the weft thread insertion through the air channel.

In these diagrams in order to clearly show the advantageous results achieved by the present invention, FIG. 1 is showing a weft thread insertion without any control of the weft thread insertion.

The reduction of the spool diameter from D to d or the weft thread use SFV is depicted on the abscissa of the diagrams, and the thread transit time FFZ and the energy required EB are shown on the ordinate.

In FIG. 1, the transit time FFZ of the weft thread is shown in its dependence on the diameter of the thread supply bobbin during a constant energy application EB for the weft thread insertion into air insertion channel through the loom shed of a weaving machine, whereby the weft thread insertion is not controlled. From FIG. 1 it is clear that the reduction of the threads up diameter from D to d also causes a reduction of the transit time FFZ of the weft thread through the loom shed or channel. It is further shown, that the energy requirement EB of air, an important parameter for the weft thread insertion in air nozzle looms, is independent of the thread supply amount on the bobbin and remains constant. The thread transit time FFZ and the energy EB used for the weft thread insertion are therefore not dependent on one another. These are serious disadvantages, because on the one hand, different thread transit times have a negative influence on the productivity or efficiency of the loom, and because, on the other hand, the same energy requirement, as is needed for the pulling of a weft thread from a full thread supply, is applied for pulling a thread supply from a bobbin that is almost empty which is a waste of energy, since a continuously constant energy supply is in fact not needed.

Following from the above mentioned state of affairs, one tries to influence the weft thread insertion speed, and thereby also the weft thread transit time FFZ, in an effort to hold them constant. For this purpose the energy requirement EB namely the volume of air passing through the relay nozzles, not depicted in FIG. 4, for transporting the weft thread through the loom shed, must be adjusted to the changing conditions of the thread supply bobbin 1A.

This adjustment is achieved by means of a known weft thread insertion control of the closed loop type as, for example, disclosed in the above mentioned U.S. Pat. No. 5,031,672 (Wahhoud et al.). FIG. 2 shows the result of such a control which requires a rated value 5 for the thread transit or insertion time FFZ of the weft thread through the loom shed. The energy consumption or requirement EB needed to guarantee a constant thread transit time FFZ from weft thread entry into the channel to weft thread exit from the shed over the width of the loom shed, is dependent on the momentary amount of thread supply on each thread bobbin 1A, 2A, 3A, etc. That is to say, the demand for transport medium, that must pass through the individual relay nozzles or relay nozzle groups in order to transport the weft thread to be inserted in the loom shed, decreases continually as the yarn supply on the thread bobbins 1A, 2A, etc. decreases, essentially until the thread supply reaches "zero" on the bobbins 1B, 2B, etc.

Such a decrease means, relative to the time duration during which blowing medium, e.g. air passes through the relay nozzles or groups of relay nozzles in the loom, that the time duration for controlling the valves for operating the relay nozzles and thus also the blowing duration of the relay nozzles, are reduced.

During the transfer of the weft thread from a thread supply bobbin 1B that is running out, to a full thread supply bobbin 2A, an increase in the thread transit time FFZ over the rated value 5 to an actual value 6 per weft thread is registered, due to the conditions occurring at the time of the thread transfer. This increase Δ FFZ1 in the thread transit time FFZ from a rated value at position 5 to a value 6 lying above the rated value at position 5 is shown in FIG. 2.

The energy requirement EB (rated value 4.1) is preset or given by the closed loop control as it works on a weft thread at the start of pulling a thread off a full thread supply bobbin. Therefore, this energy requirement EB cannot be exceeded during the thread transfer. For this reason, the thread transit time $\Delta$ FFZ$_1$ must increase in this time interval as shown at ΔFFZ1 in FIG. 2. This fact leads to loose threads in the fabric being woven, whereby inferior fabrics are produced. The present invention now overcomes this problem.

FIG. 3 shows a spool over-flow sensor 7 connected according to the invention between the thread supply bobbin 1B that is running out and the full thread supply bobbin 2A. This sensor 7 detects the transfer of the weft thread from the one thread supply bobbin 1B to the other thread supply bobbin 2A. The sensor supplies a respective transfer signal to the central control unit of the air nozzle loom, not depicted here. This transfer signal also determines a time period when a weft thread transition from one bobbin 1B to the other bobbin 2A is taking place. An operation interval 8 of a thread transfer travelling pattern is interposed or inserted at least during a portion of said time period, whereby the normal travelling pattern according to the central control program is temporarily replaced by the transfer travelling pattern. The normal program controlled travelling pattern causes a sequential control of the valves for the relay nozzles or groups of relay nozzles that are distributed along the fabric width. This interposing of a transfer travelling pattern takes place either during or directly after the thread supply 1B runs out. The interposing begins by switching from the lower rated energy value shown at position 4.2 to the higher rated energy value 4.1 in FIG. 3. This interposing may be realized by, for example, a temporary pressure increase of the medium that is effective on the weft thread as shown at 4.1 or the impulse duration of individual relay nozzles or groups of relay nozzles may be temporarily increased. Such interposing leads to, as FIG. 3 shows, the fact that the weft thread transit time FFZ-ΔFFZ2 of the weft thread of the thread supply 1B, 2B that is running out, is temporarily lower relative to the thread transit time FFZ (rated value shown at 5) which is fixed according to the central control program of the loom. To lower the transit time by ΔFFZ2, the weft thread is carried faster through the loom hence in a shorter time duration $FFZ-\Delta FFZ_2$ in the thread transfer time interval 8. After a starting length of weft thread is pulled off from the thread supply bobbin 2A, 3A or until the thread transfer time 8 has reached at its rated value shown at 5 again, the travelling pattern according to the central control program is resumed.

With these steps of the present invention, as can be seen by comparing the diagrams of FIGS. 2 and 3, it is achieved that, as a result of a direct thread transfer from empty supply to full supply, loose threads in the fabric, prolonged weft insertion times, and even shutting down of the loom are avoided during the thread transfer time 8 from one thread supply bobbin to another thread supply bobbin. With the formation of a transitional travelling pattern as taught herein, these disadvantages are completely prevented.

Figure 4:
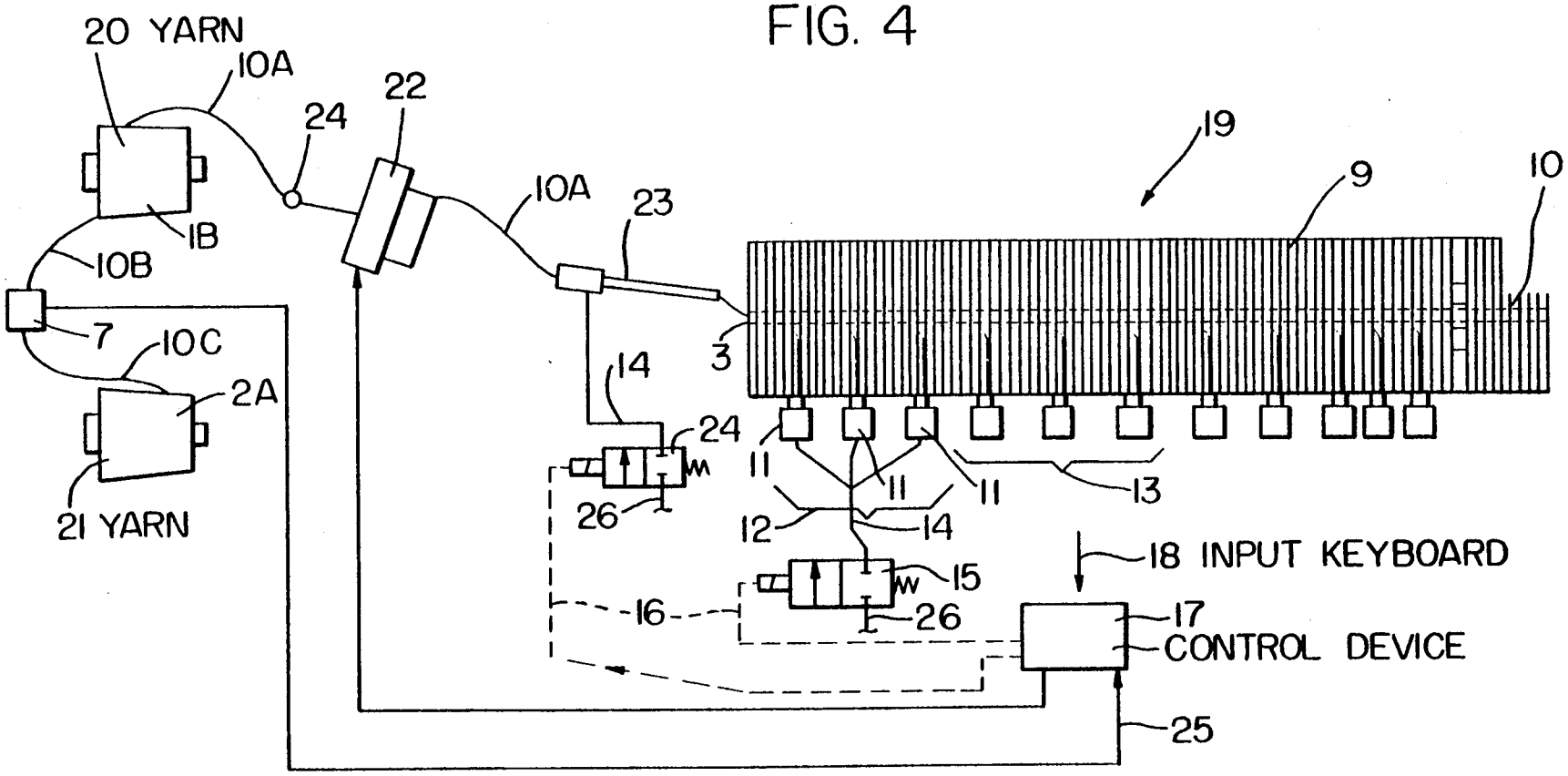
FIG. 4 shows a schematic plan view of the weft thread insertion components of an air jet loom of the above mentioned U.S. Pat. No. 5,031,672 (Wahhoud et al.) modified according to the present invention.

FIG. 4 shows schematically a weaving reed 9 of an air loom 19. The weaving reed 9 forms an air insertion channel 10 for the weft thread 10A. A main nozzle 23 transports the weft thread 10A into the entrance 3 of the air insertion channel 10. The auxiliary nozzles 11 may be arranged in groups 12, 13, and so forth, or they may be individually arranged for control individually or in groups. For this purpose control ducts 14 connect an outlet of an electromagnetically controlled valve 15 to the individual auxiliary nozzles 11. The electromagnetically controlled valve 15 is constructed as a two-way valve. The valve 15 is controlled through an electrical conductor 16 which in turn is connected to a central control device 17 which receives its input instructions through a keyboard terminal 18. At the inlet side of the reed 9 there are arranged two supply bobbins 1B and 2A. These are the same bobbins that are also shown at 1B and 2A in FIG. 3. The bobbin 1B carries yarn 20 having a thread end 10B. The bobbin 2A carries yarn 21 having a thread leading end 10C. The two thread ends 10B and 10C are interconnected as mentioned above and run through a sensor 7 as also shown in FIG. 3. The thread 10A travels through a thread guide 24 and then to a preliminary reeling device 22. The weft thread 10A exiting from the preliminary reeling device 22 passes into the main nozzle 23 that transports the thread into the entrance 3 of the insertion channel 10 of the reed 9. The main nozzle 23 is also controlled in its fluid supply by an electromagnetically controlled valve 24 connected through another electrical conductor 16 to the central control device 17. Depending on the control of the valves 15 and 24, is supplied to the main nozzle 23 and to the auxiliary nozzles 11.

According to the invention, a thread transfer control is provided through the central control device 17 that receives an input signal from the sensor 7 through the electrical conductor 25. The signal from the sensor 7 signifies a time period when a transition from one bobbin 1B to the other bobbin 2A is taking place. The sensor 7 as a result of the transfer, produces a respective signal, whereby the valve 15 for the auxiliary nozzles 11 are so controlled that transport air to the nozzles 11 for transporting the weft thread, is provided through the conduits 14 and 26. This additional transport air may be supplied to the nozzles 11 at an increased pressure, or according to a second possibility the control of the auxiliary nozzles 11 receives the additional air for a time duration that is slightly longer than the time duration that would be allocated to the particular nozzle 11 in the ordinary transport when no transfer takes place from one bobbin to the other.

Although the invention has been described with reference to specific example embodiments, it will be appreciated that it is intended to cover all modifications and equivalents within the scope of the appended claims.

What we claim is:

1. A method for controlling a weft thread transfer from a now empty bobbin to a full bobbin during the insertion of a weft thread into a shed of an air nozzle weaving loom having a main nozzle and a plurality of relay nozzles, wherein said weft thread is supplied by several thread supply bobbins, comprising the following steps:

(a) determining a time period when a weft thread transfer is taking place from the empty to the full bobbin, (b) interrupting a normal program controlled weft thread travelling pattern caused by said plurality of relay nozzles at least during a portion of said predetermined time period and interposing during said interrupting a weft thread transfer travelling pattern on said weft thread by respectively controlling an operation of said relay nozzles in accordance with said weft thread transfer travelling pattern, (c) maintaining said weft thread transfer travelling pattern by said controlling of said relay nozzles for a length of time sufficient to assure a desired weft thread transport by said relay nozzles during said interrupting, said weft thread transfer travelling pattern controlling said relay nozzles whose activation time coincides with said time period of said weft thread transfer from said empty bobbin to said full bobbin, in such a manner that said weft thread transfer is further accelerated during said time period and the travelling speed of said weft thread is temporarily increased for reducing a transfer time, and (d) resuming said normal program controlled weft thread travelling pattern when said weft thread transfer is completed, whereby a continuous, uniform weft thread insertion is assured.

2. The method of claim 1, wherein said weft thread transfer travelling pattern is maintained until a predetermined number of weft threads have been inserted into said shed following said transfer from the empty to the full supply bobbin.

3. The method of claim 1, wherein said weft thread transfer travelling pattern is maintained until a weft thread transit time through said shed has reached a rated transit time value.

4. The method of claim 1, wherein said step of determining comprises detecting said weft thread transfer to provide a respective control signal, and controlling said interposing step in response to said control signal for respectively operating said relay nozzles.

5. The method of claim 4, wherein said detecting step is performed by guiding a weft thread transferring from the now empty bobbin to the full bobbin, through a thread detector for producing said respective control signal for said relay nozzles.

6. The method of claim 1, wherein an end of a weft thread from the now empty bobbin is connected to a beginning of the weft thread on the still full bobbin.

7. The method of claim 1, wherein said interposing is performed by increasing a weft thread transport fluid supply during said time sufficient to assure a desired weft thread transport.

8. The method of claim 1, wherein said weft thread transfer travelling pattern is established by controlling said relay nozzles individually or in groups.

9. The method of claim 1, wherein said interposing step is maintained any time during said weft thread transfer.

10. The method of claim 1, wherein said interposing step begins immediately when said weft thread transfer from the now empty bobbin to the full bobbin is completed.

11. The method of claim 1, wherein said interposing is performed by increasing the pressure of a weft thread transport fluid supply during said weft thread transfer travelling pattern.

* * * * *